US007730976B2

(12) United States Patent
McClain et al.

(10) Patent No.: US 7,730,976 B2
(45) Date of Patent: Jun. 8, 2010

(54) IMPREGNATED ROTARY DRAG BIT AND RELATED METHODS

(75) Inventors: Eric E. McClain, Spring, TX (US); Marcus R. Skeem, Sandy, UT (US)

(73) Assignee: Baker Hughes Incorporated, Houston, TX (US)

( * ) Notice: Subject to any disclaimer, the term of this patent is extended or adjusted under 35 U.S.C. 154(b) by 181 days.

(21) Appl. No.: 11/932,432

(22) Filed: Oct. 31, 2007

(65) Prior Publication Data

US 2009/0107732 A1 Apr. 30, 2009

(51) Int. Cl.
*E21B 10/43* (2006.01)

(52) U.S. Cl. ..... 175/431; 175/434; 76/108.2

(58) Field of Classification Search ..... 175/431, 175/434; 76/108.2
See application file for complete search history.

(56) References Cited

U.S. PATENT DOCUMENTS

| | | | | |
|---|---|---|---|---|
| 4,109,737 | A | 8/1978 | Bovenkerk | |
| 4,373,593 | A | 2/1983 | Phaal et al. | |
| 4,499,958 | A | 2/1985 | Radtke et al. | |
| 4,776,411 | A | 10/1988 | Jones | |
| 4,794,994 | A | 1/1989 | Deane et al. | |
| 4,813,500 | A | 3/1989 | Jones | |
| 4,823,892 | A | 4/1989 | Fuller | |
| 4,848,489 | A | 7/1989 | Deane | |
| 4,889,017 | A | 12/1989 | Fuller et al. | |
| 4,907,662 | A | 3/1990 | Deane et al. | |
| 4,913,247 | A | 4/1990 | Jones | |
| 4,943,488 | A | 7/1990 | Sung et al. | |
| 4,991,670 | A | 2/1991 | Fuller et al. | |
| 5,033,559 | A | 7/1991 | Fischer | |
| 5,049,164 | A | 9/1991 | Horton et al. | |
| 5,303,785 | A | 4/1994 | Duke | |
| 5,582,261 | A | 12/1996 | Keith et al. | |
| 5,722,499 | A | 3/1998 | Nguyen et al. | |
| 5,732,784 | A | 3/1998 | Nelson | |
| 5,937,958 | A * | 8/1999 | Mensa-Wilmot et al. | 175/398 |
| 6,003,623 | A | 12/1999 | Miess | |
| 6,009,962 | A | 1/2000 | Beaton | |
| 6,021,858 | A | 2/2000 | Southland | |

(Continued)

FOREIGN PATENT DOCUMENTS

| | | | |
|---|---|---|---|
| EP | 0291314 | A2 | 11/1988 |

(Continued)

*Primary Examiner*—William P Neuder
(74) *Attorney, Agent, or Firm*—TraskBritt

(57) ABSTRACT

A drill bit is provided that employs a plurality of discrete, post-like, abrasive, particulate-impregnated cutting structures extending upwardly from the bit face. The cutting structures may be disposed on abrasive, particulate-impregnated blades that also define a plurality of fluid passages on the bit face. One or more of the cutting structures may include outermost ends that exhibit a cross-sectional geometry that is elongated in a direction along a defined axis. The cutting structures may be oriented such that the defined axis is neither coplanar with, nor parallel to, an intended rotational path of the at least one discrete cutting structure during operation of the bit. In one embodiment, the cutting structure is oriented such that the defined axis is at an acute angle relative to a tangent of the intended rotational path for the associated cutting structure. Other or different features may include, for example, additional, differently configured cutting elements.

25 Claims, 5 Drawing Sheets

U.S. PATENT DOCUMENTS

| | | | | |
|---|---|---|---|---|
| 6,062,325 | A | 5/2000 | Taylor et al. | |
| 6,095,265 | A | 8/2000 | Alsup | |
| 6,142,250 | A | 11/2000 | Griffin et al. | |
| 6,216,805 | B1 | 4/2001 | Lays et al. | |
| 6,241,036 | B1 | 6/2001 | Lovato et al. | |
| 6,296,069 | B1 | 10/2001 | Lamine et al. | |
| 6,401,844 | B1 | 6/2002 | Doster et al. | |
| 6,458,471 | B2 | 10/2002 | Lovato et al. | |
| 6,510,906 | B1 | 1/2003 | Richert et al. | |
| 6,843,333 | B2 | 1/2005 | Richert et al. | |
| 2008/0179108 | A1* | 7/2008 | McClain et al. | 175/431 |

FOREIGN PATENT DOCUMENTS

| | | | |
|---|---|---|---|
| EP | 0291314 | A3 | 11/1988 |
| EP | 0418706 | A1 | 3/1991 |
| EP | 0720879 | A2 | 7/1996 |
| EP | 0720879 | A3 | 10/1997 |
| EP | 0874128 | A2 | 10/1998 |
| FR | 2375428 | A1 | 7/1978 |
| FR | 2504589 | A1 | 10/1982 |
| GB | 2347957 | A | 9/2000 |
| GB | 2353053 | A | 2/2001 |
| GB | 2353548 | A | 2/2001 |
| WO | 9748877 | A1 | 12/1997 |
| WO | 9827311 | A1 | 6/1998 |
| WO | 9936658 | A1 | 7/1999 |

* cited by examiner

IMPREGNATED ROTARY DRAG BIT AND RELATED METHODS

FIELD OF THE INVENTION

The present invention relates generally to fixed cutter or drag-type bits for drilling subterranean formations and, more specifically, to drag bits for drilling hard and/or abrasive rock formations, including bits for drilling such formations that are interbedded with soft and nonabrasive layers.

BACKGROUND

So-called "impregnated" drag bits are conventionally used for drilling hard and/or abrasive rock formations, such as sandstones. Such impregnated drill bits conventionally employ a cutting face composed of superabrasive cutting particles, such as natural or synthetic diamond grit, dispersed within a matrix of wear-resistant material. During drilling, the matrix and the embedded diamond particles experience wear. Worn cutting particles become lost from the cutting face and new cutting particles are exposed. The abrasive particles may include natural or synthetic diamonds and may be integrally cast with the body of the bit, as in low-pressure infiltration. Additionally, features of a drill bit having abrasive particles may be preformed separately from the bit body, as in hot isostatic pressure infiltration, and subsequently attached to the bit by brazing or by furnacing them to the bit body in an infiltration process during manufacturing of the bit.

It is recognized that conventional impregnated bits generally exhibit a poor hydraulics design, often employing a "crow's foot" to distribute drilling fluid across the bit face and, thus, providing only minimal flow area for the drilling fluid. Further, conventional impregnated bits do not drill very effectively when the bit encounters softer and less abrasive layers of rock, such as shales. When drilling through shale, or other soft formations, with a conventional impregnated drag bit, the cutting structure tends to quickly clog or "ball up" with formation material, reducing the effectiveness of the drill bit. The softer formations can also result in the plugging of fluid courses formed in the drill bit, causing heat buildup and premature wear of the bit. Therefore, when shale-type formations are encountered, a more aggressive bit is desired to achieve a higher rate of penetration (ROP). It follows, therefore, that selection of a bit for use in a particular drilling operation becomes more complicated when it is expected that formations of more than one type will be encountered during the drilling operation.

One type of impregnated bit used to drill in varied formations includes that which is described in U.S. Pat. No. 6,510,906, issued to Richert et al. (hereinafter "the Richert '906 patent") and assigned to the assignee hereof, the disclosure of which is incorporated by reference herein in its entirety. The Richert '906 patent describes a drill bit employing a plurality of discrete, post-like, abrasive, particulate-impregnated cuffing structures extending upwardly from abrasive particulate-impregnated blades. The blades define a plurality of fluid passages along the bit face. In one embodiment, polycrystalline diamond compact (PDC) cutters are placed in a relatively shallow cone portion of the bit. The PDC cutters may be used to promote enhanced drilling efficiency through softer, nonabrasive formations. A plurality of ports, configured to receive nozzles therein, are distributed on the bit's face to improve drilling fluid flow and distribution. The Richert '906 patent describes various configuration of the blades including blades that extend radially in a linear fashion as well as blades that are curved or spiral outwardly to a gage portion.

Another impregnated drag bit is described in U.S. Pat. No. 6,843,333 issued to Richert et al. (hereinafter "the Richert '333 patent") and assigned to the assignee hereof, the disclosure of which is incorporated by reference herein in its entirety. The Richert '333 patent describes another drill bit that employs a plurality of discrete, post-like, abrasive, particulate-impregnated cutting structures extending upwardly from abrasive, particulate-impregnated blades. In one embodiment described in the Richert '333 patent, discrete protrusions extend outwardly from at least some of the plurality of discrete cutting structures. The discrete protrusions are formed of a material such as a thermally stable diamond product. In one particular embodiment, the discrete protrusions exhibit a generally triangular cross-sectional geometry relative to the direction of intended bit rotation. It is stated that such discrete protrusions act as "drill out" features that enable the bit to drill through certain structures such as a float shoe or hardened cement at the bottom of a well bore casing.

However, there is an ongoing desire to improve the effectiveness of drill bits, including so-called impregnated drag bits. For example, it would be beneficial to design a durable drill bit that provides more aggressive performance in softer, less abrasive, formations while also providing effective ROP in harder, more abrasive, formations without requiring increased weight on bit (WOB) during the drilling process.

BRIEF SUMMARY OF THE INVENTION

The present invention provides a rotary drag bit employing impregnated cutting elements including cutting elements in the form of discrete, post-like, mutually separated cutting structures projecting upwardly from generally radially extending blades on the bit face, the blades defining fluid passages therebetween extending to junk slots on the bit gage.

In accordance with one embodiment of the present invention, a rotary bit for drilling subterranean formations is provided. The bit includes a bit body having a face. A plurality of discrete, mutually separated cutting structures comprising a particulate abrasive material protrude outwardly from the face. At least one discrete cutting structure of the plurality includes an outer end exhibiting a first dimension in a direction along a defined axis, and a second dimension in a direction substantially perpendicular to the defined axis, wherein the defined axis is oriented at an acute angle relative to a tangent of an intended rotational path of the at least one cutter during rotational operation of the bit.

In accordance with another embodiment of the present invention, another rotary bit for drilling subterranean formations is provided. The bit includes a bit body having a face. A plurality of discrete, mutually separated cutting structures comprising a particulate abrasive material protrude outwardly from the face. At least one discrete cutting structure of the plurality includes an outer end exhibiting a first dimension in a direction along a defined axis, and a second dimension in a direction substantially perpendicular to the defined axis, wherein the defined axis is neither coplanar with, nor parallel to, the intended rotational path of the at least one cutting structure during operation of the bit.

In accordance with a further embodiment of the present invention, yet another rotary bit for drilling subterranean formations is provided. The bit includes a bit body having a face with a plurality of discrete, mutually separated cutting structures comprising a particulate abrasive material protruding outwardly from the face. At least one discrete cutting structure of the plurality includes an outer end exhibiting a first dimension in a direction along a defined axis, and a second dimension in a direction substantially perpendicular to the defined axis, wherein the defined axis is oriented at an acute angle relative to a radial axis of the bit extending from a centerline of the bit through the at least one cutting structure.

DETAILED DESCRIPTION OF THE INVENTION

Figure 1:
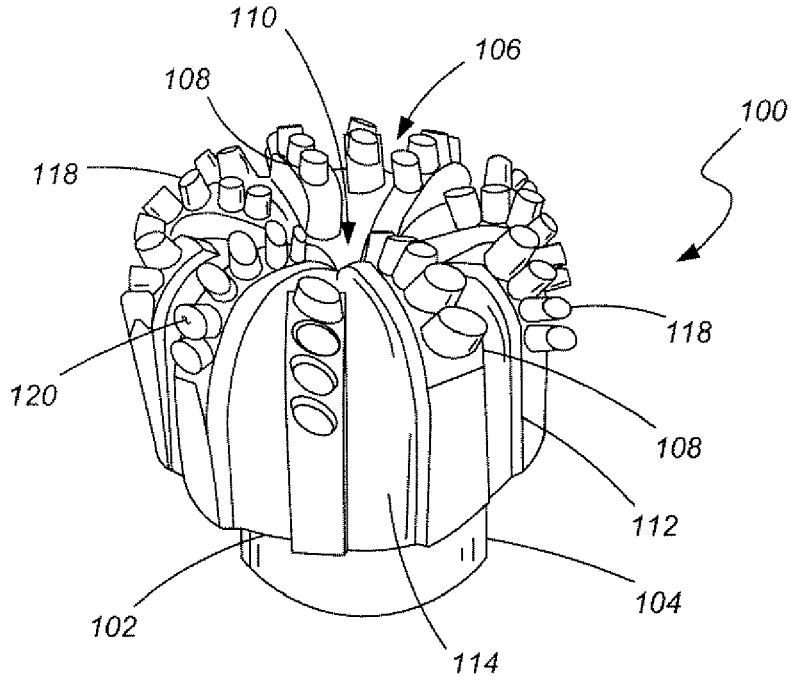
FIG. 1 is an inverted perspective view of a first embodiment of a bit of the present invention.
Figure 2:
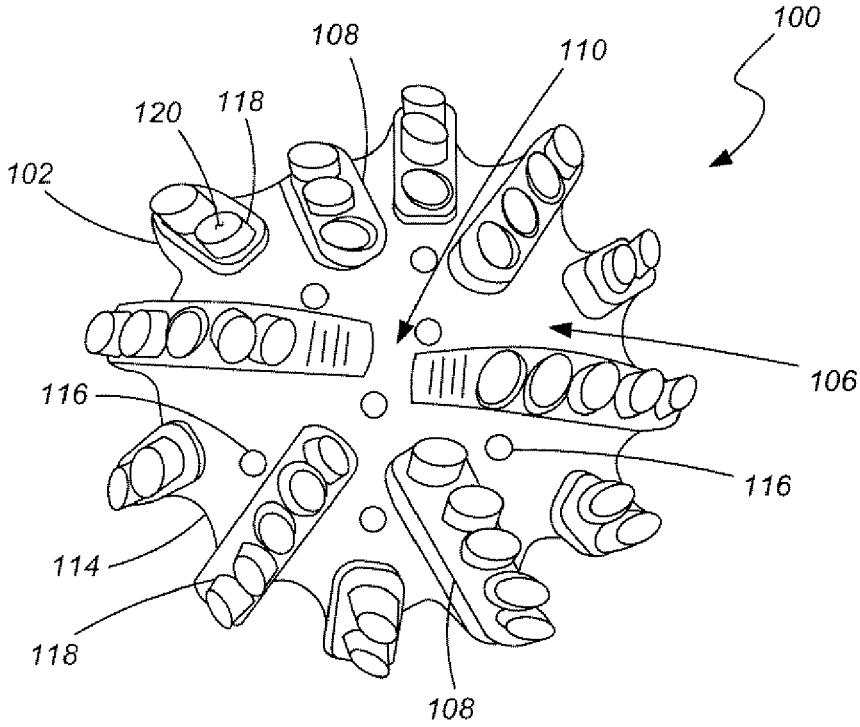
FIG. 2 is an end view of the bit face of the bit shown in FIG. 1.

Referring now to FIGS. 1 and 2 of the drawings, a drill bit 100 according to an embodiment of the present invention is shown in perspective, the bit 100 being inverted from its normal face-down operating orientation for purposes of convenience and clarity. The bit 100 may be, by way of example only, of 8.5 inches in diameter and include a matrix-type bit body 102 having a shank 104 for connection to a drill string (not shown) extending therefrom opposite the bit face 106. A plurality of blades 108 extends generally radially outwardly across the bit face 106. In the embodiment shown in FIGS. 1 and 2, the blades 108 extend in a generally linear fashion from a cone portion 110, which includes the portion of the face 106 configured generally as a cone about a centerline of the bit 100, to gage pads 112 located generally at the outer diameter of the bit body 102. Junk slots 114 are defined between the generally radially extending blades 108. The bit 100 may also employ a plurality of ports 116 over the bit face 106 to enhance fluid velocity of drilling fluid flow and better apportion the flow over the bit face 106 and among fluid passages between blades 108 and extending to junk slots 114.

Discrete, impregnated cutting structures 118, which may comprise posts, extend upwardly or outwardly (as shown in FIG. 1) from blades 108 formed on the bit face 106. In one embodiment, the cutting structures 118 are integrally formed with the matrix-type blades 108 projecting from the matrix-type bit body 102 such as by hand-packing diamond grit-impregnated matrix material in mold cavities on the interior of the bit mold defining the locations of the cutting structures 118 and blades 108 such that each blade 108 and associated cutting structure 118 defines a unitary structure. In another embodiment, the cutting structures 118 may be placed directly on the bit face 106, dispensing with the blades. However, as discussed in more detail below, it may be desirable in certain circumstances to have the cutting structures 118 located on the blades 108.

It is also noted that, while the presently described embodiment is discussed in terms of the cutting structures 118 being integrally formed with the bit 100, the cutting structures 118 may be formed as discrete individual segments or structures, such as by hot isostatic pressing, and subsequently brazed or furnaced onto the bit 100.

Discrete cutting structures 118 are mutually separated from each other to promote drilling fluid flow therearound for enhanced cooling and clearing of formation material removed by the diamond grit or other abrasive material. In one embodiment discrete cutting structures 118, as shown in FIGS. 1 and 2, may generally exhibit an oval or elliptical transverse cross-section at their outermost ends 120. The outermost ends 120 of the discrete cutting structures 118 may be substantially flat, or, in other embodiments, by exhibit more rounder or angular geometries.

The discrete cutting structures 118 may change in cross-sectional geometry based on the distance from the face of the blades 108. For example, referring to FIGS. 3A and 3B, the discrete cutting structures 118 may be substantially tapered such that they exhibit a changing cross-section (a change in the size of the cross-section, the geometry of the cross-section, or both) as they wear. In the embodiment shown in FIGS. 3A and 3B, as the cutting structures wear (e.g., as the distance decreases between the outermost end 120 and the face of the associated blade 108), the outermost ends 120 become generally wider or more elongated in one or more directions. Such a configuration may provide added strength and durability to the cutting structures 118. As the discrete cutting structures 118 wear, the exposed surface area of the outermost ends 120 increases, providing progressively increasing contact area for the diamond grit, or other abrasive material, with the formation material. Thus, as the cutting structures 118 wear down, the bit 100 takes on the configuration of a heavier-set bit more adept at penetrating harder, more abrasive formations. Even if discrete cutting structures 118 wear completely away, the diamond-impregnated blades 108 will provide some cutting action, reducing the possibility of ring-out and having to prematurely pull the bit 100 from a formation.

Figure 3A:
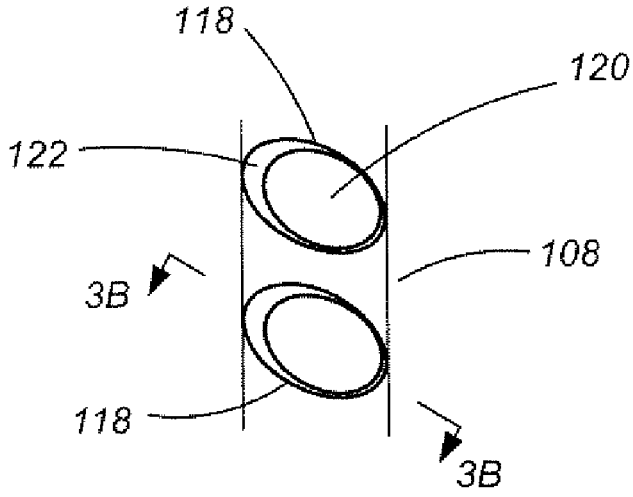
FIG. 3A is a schematic top view showing portions of a blade of the bit shown in FIGS. 1 and 2 carrying discrete cutting structures and FIG. 3B is an enlarged cross-sectional elevation taken across line 3B-3B of FIG. 3A.
Figure 3B:
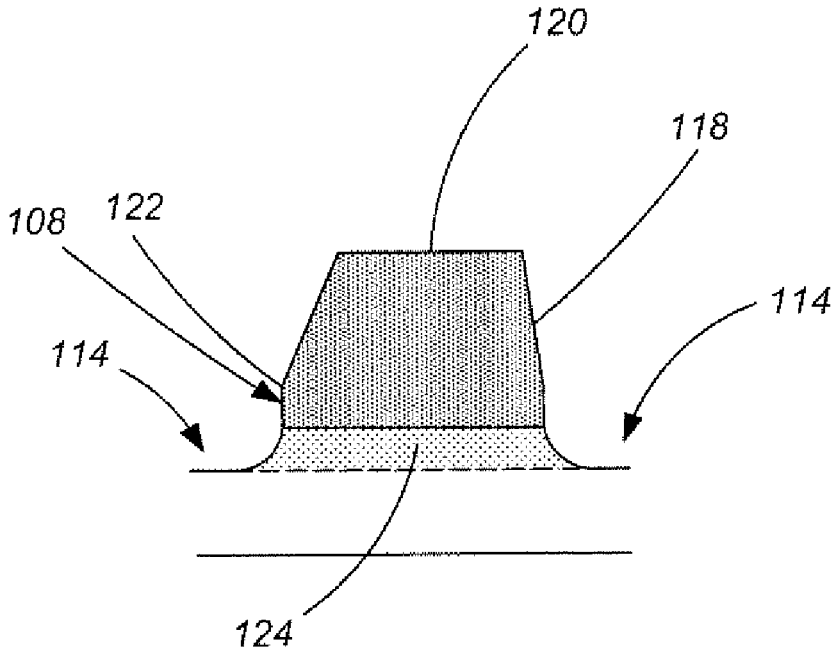

While the cutting structures 118 are illustrated as posts exhibiting slightly elliptical outer ends 120 (being substantially defined by a major diameter and a minor diameter) with relatively enlarged bases 122, other geometries are also contemplated. For example, the outermost ends 120 of one or more cutting structures 118 may be configured to initially exhibit circular, oval, square, rectangular, diamond shaped or other polygonal geometries. The base 122 portion of the cutting structures 118 adjacent the blade 108 might also exhibit different geometries than what is depicted in FIGS. 3A and 3B.

As previously noted, the ends of the cutting structures 118 need not be flat, but may employ sloped geometries. Furthermore, it is noted that the spacing between individual cutting structures 118, as well as the magnitude of the taper from the outermost ends 120 to the blades 108, may be varied to change the overall aggressiveness of the bit 100 or to change the rate at which the bit is transformed from a light-set bit to a heavy-set bit during operation. It is also contemplated that one or more of such cutting structures 118 may be formed to have substantially constant cross-sections if so desired depending on the anticipated application of the bit 100. Thus, various configurations are contemplated.

As previously indicated, the discrete cutting structures 118 may comprise a natural or synthetic diamond grit. A tungsten carbide matrix material may be mixed with such diamond grit. In one embodiment, a fine grain carbide, such as, for example, DM2001 powder commercially available from Kennametal Inc., of Latrobe, Pa., may be mixed with the diamond grit to form discrete cutting structures 118 and supporting blades 108. Such a carbide powder, when infiltrated, provides increased exposure of the diamond grit particles in comparison to conventional matrix materials due to its relatively soft, abradable nature.

In one embodiment, a base portion 124 of each blade 108 may desirably be formed of a more durable matrix material. Use of the more durable material in this region helps to prevent ring-out even when all of the discrete cutting structures 118 have been abraded away and the majority of each blade 108 is worn. Thus, the materials used to form the various components of the bit 100 may be tailored to exhibit certain characteristics and properties as desired.

Of course, other particulate abrasive materials may be suitably substituted for those discussed above. For example, the discrete cutting structures 118 may include natural diamond grit, or a combination of synthetic and natural diamond grit. In another embodiment, the cutting structures may include synthetic diamond pins. Additionally, the particulate abrasive material may be coated with a single layer or multiple layers of a refractory material, as known in the art and disclosed in U.S. Pat. Nos. 4,943,488 and 5,049,164, the disclosures of each of which are hereby incorporated herein by reference in their entirety. Such refractory materials may include, for example, a refractory metal, a refractory metal carbide or a refractory metal oxide. In one embodiment, the refractory material coating may exhibit a thickness of approximately 1 to 10 microns. In another embodiment, the coating may exhibit a thickness of approximately 2 to 6 microns. In yet another embodiment, the coating may exhibit a thickness of less than 1 micron.

Figure 4:
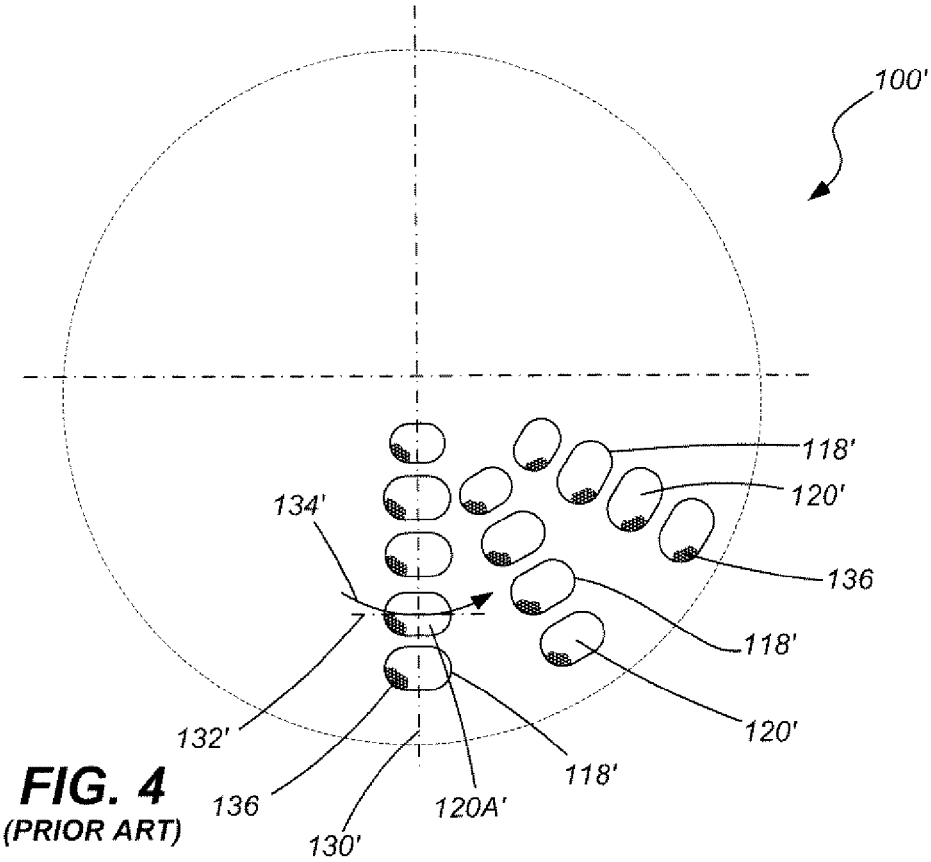
FIG. 4 (PRIOR ART)
FIG. 4 is a schematic end view of a prior art bit showing the outermost ends of discrete cutting structures superimposed in a planar view.

Referring now to FIG. 4, a schematic end view of a prior art bit 100' is shown wherein the outermost ends 120' of cutting structures 118' are rotated into a planar view. Some (or all) of the cutting structures 118' exhibit outermost ends that are substantially elongated in one direction. For example, considering an outermost end identified at 120A', it exhibits a cross-sectional geometry of an ellipse or an oval wherein a first dimension measured along a radial axis 130' of the bit and a second dimension is measured in a direction substantially perpendicular to the radial axis 130' of the bit. The second dimension is greater than the first dimension. Stated another way, the first dimension is measured along the minor axis of the elliptical cross section while the second dimension is measured along the major axis of the elliptical cross section. The major axis may also be referred to herein as an axis of elongation 132'. Thus, considering that the outermost ends 120' may exhibit cross-sectional geometries that are other than elliptical or oval, it may be generally stated that the cross-sectional geometry of the outermost end 120' exhibits a dimension along the axis of elongation 132' that is greater than a dimension measured in a direction substantially perpendicular to the axis of elongation 132' (i.e., in the particular case shown in FIG. 4, in a direction along the radial axis 130' of the bit).

In the prior art example shown in FIG. 4, the axis of elongation 132' is oriented to be substantially perpendicular to the radial axis 130' of the bit. In such embodiments, it has been observed that the radially outward and rotationally trailing portions of discrete cutting structures 118' (i.e., the portions 136 of the cutting structures 118' that trail along its intended rotational path 134' and which have been identified with shading in FIG. 4), exhibit greater rates of failure than do other portions of the cutting structures.

It is believed that during operation of the bit 100', due to the forces placed on the bit 100', including the weight-on-bit and the rotational torque imposed on the bit during engagement with a selected formation, the radially outward and rotationally trailing portions 136 of the cutting structures 118' experience substantially greater stress than do other portions of the cutting structures 118'. As such, many of the cutting structures 118' exhibit failure in the areas of the identified portions 136. Such failures clearly reduce the effectiveness of the bit and result in changing the bit more frequently than is desired.

Figure 5:
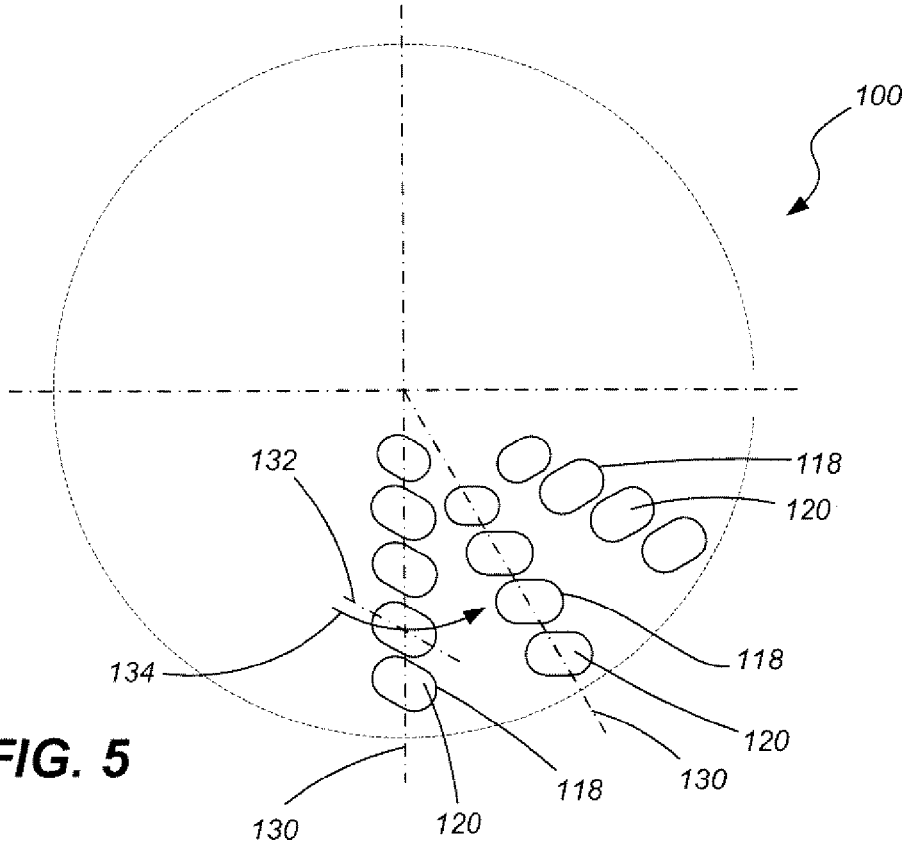
FIG. 5 is a schematic end view of the bit shown in FIGS. 1 and 2 showing the outermost ends of discrete cutting structures superimposed in a planar view.
Figure 6:
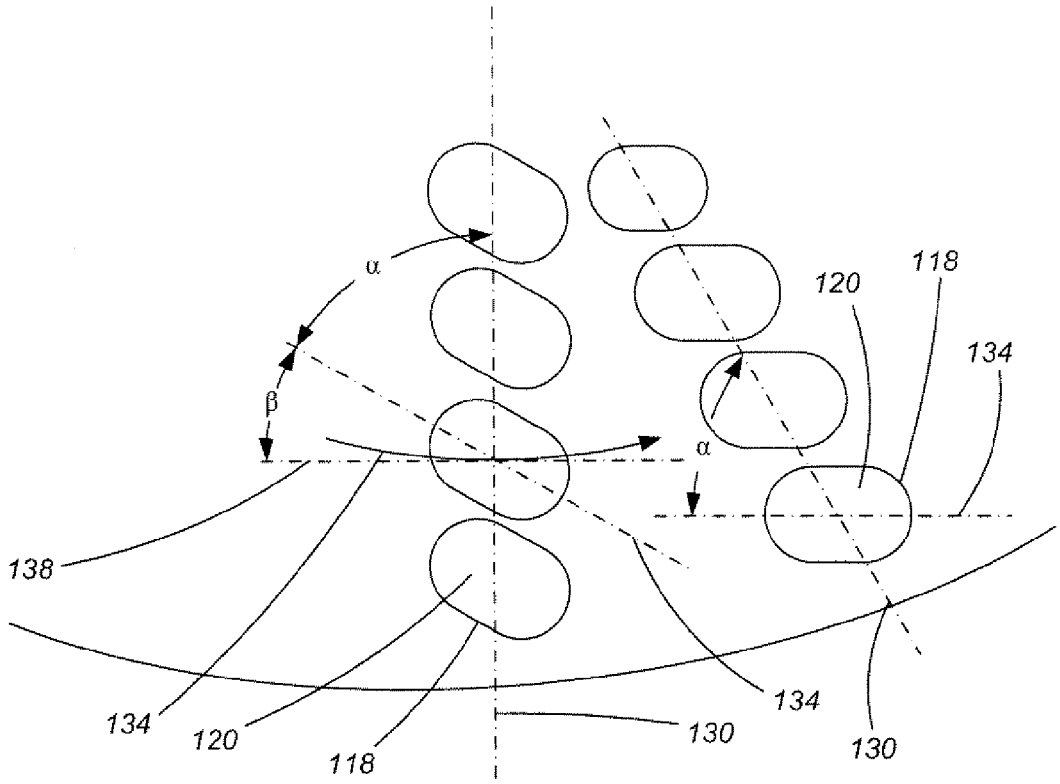
FIG. 6 is an enlarged detail of a portion of the schematic shown in FIG. 5.

Referring now to FIGS. 5 and 6, FIG. 5 shows a schematic end view of a bit 100 wherein the outermost ends 120 of cutting structures 118 are rotated into a planar view while FIG. 6 shows an enlarged view of a portion of the bit 100 shown in FIG. 5. In contrast with the prior art bit 100' shown and described with respect to FIG. 4, the cutting structures 118 of the bit 100 are configured such that the outermost end 120 of a cutting structure is oriented with its respective axis of elongation 132 forming an acute angle $\alpha$ with a radial axis 130 of the bit 100 as it extends through the cutting structure 118. Additionally, the axis of elongation 132 forms an acute angle $\beta$ with an axis 138 that extends through a central portion of the outermost end 120 of the cutting structure 118 and that is tangent to an intended rotational path 134 of the cutting structure 118. Stated another way, the axis of elongation 132 of the cutting structure 118 is not coplanar with, nor is it parallel to, the intended rotational path 134 of the cutting structure 118.

While specifically shown to displace the rotationally trailing portion of the outermost end 120 radially inwardly (i.e., toward the cone portion 110 (FIG. 2)), it is noted that another embodiment may include the rotationally trailing portion of the outermost end 120 radially outward from the cone portion 110.

In one embodiment, the angle $\alpha$ may be, for example, approximately 30° (and, accordingly, the angle $\beta$ may be approximately 60°). In another embodiment, the angle $\alpha$ may be, for example, approximately 45° (and, accordingly, the angle $\beta$ may also be approximately 45°). Of course other angles are contemplated and such embodiments should not be considered as being limiting.

The angular orientation of the cutting structure 118 is believed to alter the stress state of the cutting structures 118 during operation of the bit and reduce the stress at the rotationally trailing and radially outward portions thereof so as to reduce that likelihood of mechanical failure at such locations.

Figure 7:
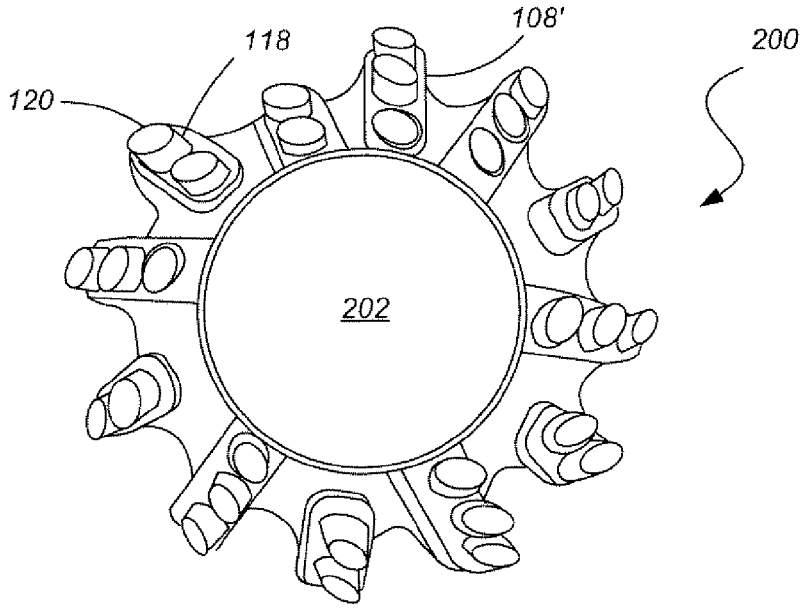
FIG. 7 is an end view of a coring bit in accordance with an embodiment of the present invention.

Referring now to FIG. 7, an end view of a coring bit 200 is shown in accordance with an embodiment of the present invention. The coring bit 200 may include a number of features similar to that of the drill bit 100 shown and described with respect to FIGS. 1 and 2 hereinabove. For example, the coring bit 200 may include a plurality of cutting structures 118 configured and oriented similar to those that have been described hereinabove. For example, the cutting structures may be formed of an abrasive material, such as natural or synthetic diamond grit, and one of more of such cutting structures may be oriented such that the axis of elongation 132 of its outermost end 120 (see FIGS. 5 and 6) is not coplanar with, or parallel to, the cutter's intended path of rotation. In one embodiment, such discrete cutting structures 118 may be positioned on one or more blades 108'. In another embodiment, the discrete cutting structures 118 may be positioned directly on the face of the coring bit 200.

The coring bit 200 also includes a substantially cylindrical opening or a throat 202 in the central portion of the coring bit 200. The throat 202 is sized and configured to enable a "core" sample of a formation that is being drilled with the coring bit 200 to pass through the throat 202 and be captured by attached tooling, often referred to as a barrel assembly, as will be appreciated by those of ordinary skill in the art. Some of the cutting structures 118 (or other additional, different types of cutting structures) may be used as so-called "gage" cutters to define the outer diameter of the bore being drilled as well as the diameter of the core sample being obtained. For example, the gage cutters may include natural diamonds (other than diamond grit) for use as cutters. As will be appreciated by those of ordinary skill in the art, analysis of the core sample recovered from the coring bit 200 can reveal invaluable data concerning subsurface geological formations including, among other things, parameters such as permeability, porosity, and fluid saturation, that are useful in the exploration for petroleum, gas, and minerals.

Figure 8:
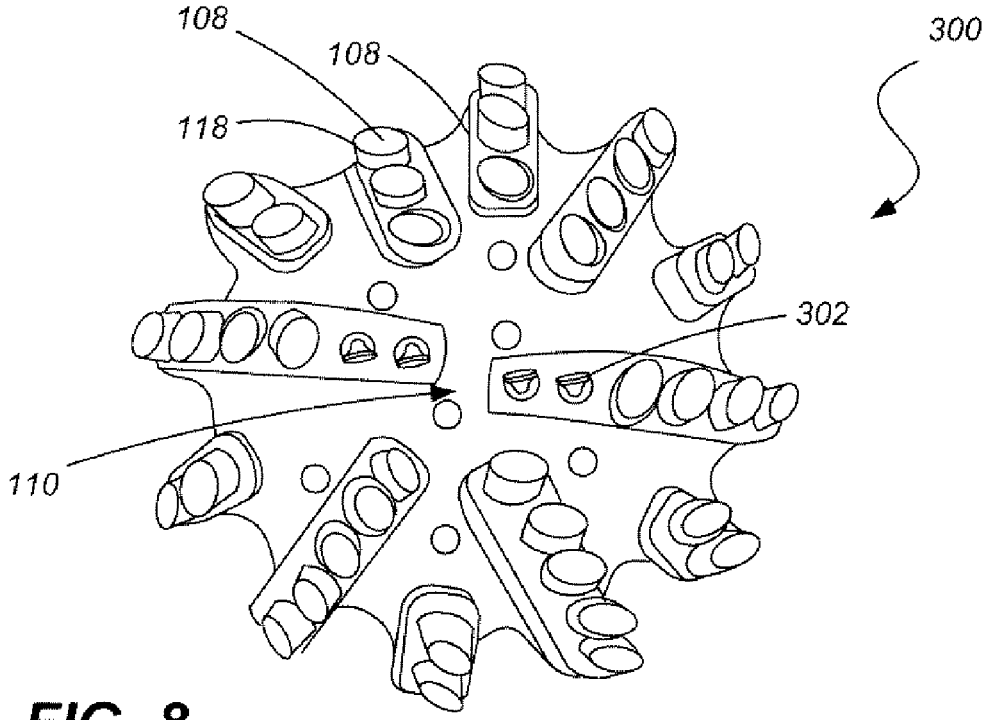
FIG. 8 is an end view of a drag bit in accordance with another embodiment of the present invention.

Referring to FIG. 8, another drag bit 300 is shown in accordance with another embodiment of the present invention. The drag bit 300 may be configured with numerous features similar to the bit 100 that is shown and described with respect to FIGS. 1 and 2. For example, the bit 300 may include a plurality of cuffing structures 118 configured and oriented similar to those that have been described hereinabove. The cuffing structures 118 may be formed of an abrasive material, such as natural or synthetic diamond grit, and one or more of such cutting structures may be oriented such that the axis of elongation 132 of its outermost end 120 (see FIG. 5) is not coplanar with, or parallel to, the cutter's intended path of rotation. In one embodiment, such discrete cutting structures 118 may be positioned on one or more blades 108. In another embodiment, the discrete cuffing structures 118 may be positioned directly on the face of the bit 300.

The bit 300 may also include additional cutting structures that are different from the discrete cutting structures 118. For example, one or more polycrystalline diamond compact (PDC) cutters 302 may be disposed on the radially innermost ends of one or more blades 108 in the cone 110 portion of the bit 300. The PDC cutters 302 may be oriented with cutting faces oriented generally facing the intended direction of bit rotation. The addition of PDC cutters 302 may provide improved performance in, for example, interbedded and shaley formations.

The bit 300 may also include additional PDC cutters 302 at other locations, or it may employ other types of cutting structures in addition to, or in lieu of, the PDC cutters 302 at any of a variety of locations on the bit 300.

Figure 9A:
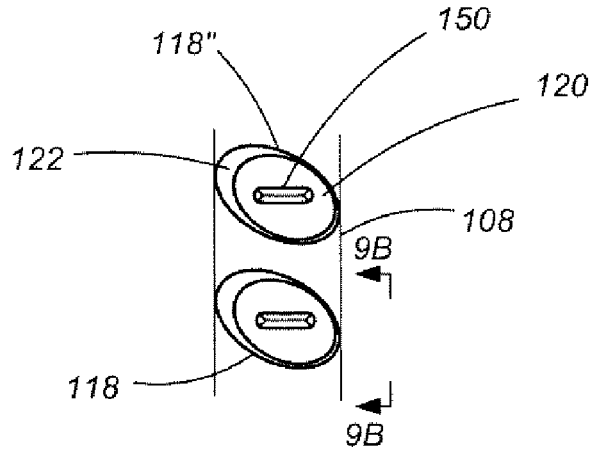
FIG. 9A is a schematic top view showing portions of a blade of the bit of a drag bit carrying discrete cutting structures and FIG. 9B is a side view, taken across line 9B-9B of FIG. 9A, of one of the cutters.
Figure 9B:
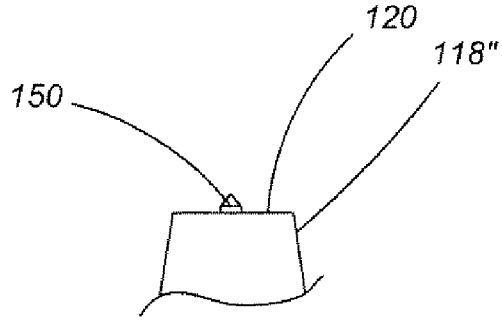

Referring now to FIGS. 9A and 9B, another embodiment of a cutting structure 118" is shown. The cutting structure 118" may include a post structure extending outwardly from the face of a bit that is configured and oriented substantially similar to the discrete cutting structures described hereinabove. Additionally, the cutting structures 118" may include what may be termed "drill out" features which enable a drill bit to drill through, for example, a float shoe and mass of cement at the bottom of a casing within a well bore.

Discrete protrusions 150, formed of, for example, a thermally stable diamond product (TSP) material, extend from a central portion of the outer end 120 of some or all of the cutting structures 118". As shown in FIG. 9B, the discrete protrusions 150 may exhibit a substantially triangular cross-sectional geometry having a generally sharp outermost end, as taken normal to the intended direction of bit rotation, with the base of the triangle embedded in the cutting structure 118" and being mechanically and metallurgically bonded thereto. The TSP material may further be coated with a refractory material including, for example, a refractory metal, a refractory metal carbide or a refractory metal oxide. In one embodiment, such a coating may exhibit a thickness of approximately 1 to 10 microns.

The discrete protrusions 150 may exhibit other geometries as well such as those described in the aforementioned U.S. Pat. No. 6,843,333. The discrete protrusions 150 are configured to augment the cutting structures 118" for the penetration of, for example, a float shoe and associated mass of cement therebelow or similar structure prior to penetrating the underlying subterranean formation.

While the bits of the present invention have been described with reference to certain exemplary embodiments, those of ordinary skill in the art will recognize and appreciate that it is not so limited. Additions, deletions and modifications to the embodiments illustrated and described herein may be made without departing from the scope of the invention as defined by the claims herein. Similarly, features from one embodiment may be combined with those of another.

What is claimed is:

1. A rotary bit for drilling subterranean formations, comprising:

a bit body having a face; and a plurality of discrete, mutually separated cuffing structures comprising a particulate abrasive material protruding outwardly from the face wherein at least one discrete cuffing structure of the plurality of discrete cutting structures includes an outer end, the outer end elongated along an axis of elongation of the at least one discrete cutting structure and wherein the axis of elongation is oriented at an acute angle relative to a tangent of an intended rotational path of the at least one discrete cutting structure during rotational operation of the bit.

2. The rotary bit of claim 1, wherein the particulate abrasive material comprises at least one of synthetic diamond grit and natural diamond grit.

3. The rotary bit of claim 1, wherein the plurality of discrete cutting structures and the face comprise a unitary structure.

4. The rotary bit of claim 1, wherein the at least one discrete cutting structure includes a base of larger cross-sectional area than the outer end thereof.

5. The rotary bit of claim 1, wherein each of the plurality of discrete cutting structures is configured as a post having a substantially flat outermost end.

6. The rotary bit of claim 1, wherein the face includes a cone portion surrounding a centerline of the bit body and wherein at least one additional cuffing element is disposed on the face of the bit body within the cone portion.

7. The rotary bit of claim 6, wherein the at least one additional cutting element comprises at least one of a polycrystalline diamond compact (PDC) cuffing element, a thermally stable diamond product (TSP), a material comprising natural diamonds, and a diamond-impregnated material.

8. The rotary bit of claim 7, further comprising a plurality of blades comprising a particulate abrasive material on the face and extending generally radially outwardly toward a gage, wherein the plurality of discrete cuffing structures are disposed on the plurality of blades.

9. The rotary bit of claim 8, wherein at least one blade of the plurality of blades extends to a location proximate the centerline, and wherein the at least one additional cuffing element is carried by the at least one blade.

10. The rotary bit of claim 1, further comprising a plurality of blades comprising a particulate abrasive material on the face and extending generally radially outwardly toward a gage, wherein the plurality of discrete cuffing structures are disposed on the plurality of blades.

11. The rotary bit of claim 10, wherein the bit body comprises a matrix-type bit body, and the plurality of blades are integral with the bit body.

12. The rotary bit of claim 10, wherein the plurality of discrete cuffing structures are integral with the plurality of blades.

13. The rotary bit of claim 12, wherein the plurality of discrete cuffing structures and the plurality of blades comprise a metal matrix material carrying a diamond grit material.

14. The rotary bit of claim 13, wherein the plurality of discrete cuffing structures and at least a portion of the plurality of blades are comprised of a softer and more abradable metal matrix material than that of the metal matrix material present in bases of the blades.

15. The rotary bit of claim 1, further comprising a plurality of discrete protrusions, wherein each discrete protrusion of the plurality of discrete protrusions extends outwardly from an associated one of the plurality of discrete cutting structures.

16. The rotary bit of claim 1, wherein each of the plurality of discrete cuffing structures includes an outer end, the outer end elongated along an axis of elongation of the at least one discrete cutting structure and wherein each axis of elongation is oriented at an acute angle relative to a tangent of an intended rotational path of its associated cuffing structure during rotational operation of the bit.

17. The rotary bit of claim 1, wherein the bit body further includes a substantially cylindrical opening about a centerline of the bit.

18. A rotary bit for drilling subterranean formations, comprising:

a bit body having a face; and a plurality of discrete, mutually separated cuffing structures comprising a particulate abrasive material, each of the plurality of discrete cutting structures having a post-shaped structure protruding outwardly from the face of the bit body and a substantially flat outermost end, the outermost end of at least one discrete cutting structure of the plurality of discrete cutting structures elongated along an axis of elongation of the at least one discrete cutting structure, and wherein the axis of elongation is neither coplanar with, nor parallel to, a tangent of an intended rotational path of the at least one discrete cutting structure during operation of the bit.

19. A rotary bit for drilling subterranean formations, comprising:

a bit body having a face; and a plurality of discrete, mutually separated cutting structures comprising a particulate abrasive material, each of the plurality of discrete cutting structures having a post-shaped structure protruding outwardly from the face of the bit body and a substantially flat outermost end, the outermost end elongated along an axis of elongation of the at least one discrete cutting structure, and wherein the axis of elongation is oriented at an acute angle relative to a radial axis of the bit extending from a centerline of the bit through the at least discrete one cutting structure.

20. A method of forming a rotary bit for drilling a subterranean formation, the method comprising:

forming a body having a face;

forming a plurality of discrete, mutually separated cutting structures to protrude outwardly from the face; and configuring a substantially flat outermost end of at least one of the plurality of discrete cutting structures to exhibit a cross-sectional geometry that is elongated in a direction along a defined axis and orienting the at least one discrete cutting structure such that the defined axis is neither coplanar with, nor parallel to, a tangent of an intended rotational path of the at least one discrete cutting structure during operation of the bit.

21. The method according to claim 20, further comprising configuring outermost ends of each of the plurality of discrete cutting structures to exhibit cross-sectional geometries that are elongated in a direction along defined axes and orienting each of the plurality of discrete cutting structures such that the defined axes are neither coplanar with, nor parallel to, a tangent of an intended rotational path of an associated discrete cutting structure during operation of the bit.

22. The method according to claim 20, further comprising orienting the at least one discrete cutting structure such that the defined axis is at an acute angle relative to the tangent of the intended rotational path of the at least one discrete cutting structure.

23. The method according to claim 20, further comprising impregnating the plurality of discrete cutting structures with at least one of synthetic diamond grit and natural diamond grit.

24. The method according to claim 20, further comprising forming at least one discrete protrusion to extend outwardly from a discrete cutting structure of the plurality of discrete cutting structures.

25. The method according to claim 20, further comprising forming a central opening about a centerline of the bit body and configuring the central opening to capture a core sample of a subterranean feature during operation of the bit.

* * * * *

UNITED STATES PATENT AND TRADEMARK OFFICE

CERTIFICATE OF CORRECTION

PATENT NO. : 7,730,976 B2
APPLICATION NO. : 11/932432
DATED : June 8, 2010
INVENTOR(S) : Eric E. McClain et al.

It is certified that error appears in the above-identified patent and that said Letters Patent is hereby corrected as shown below:

In the specification:

COLUMN 5, LINES 66-67, change "(i.e., the portions" to --(i.e., portions--

In the claims:

| | | | |
|---|---|---|---|
| CLAIM 1, | COLUMN 8, | LINE 25, | change "cuffing" to --cutting-- |
| CLAIM 1, | COLUMN 8, | LINE 28, | change "cuffing" to --cutting-- |
| CLAIM 6, | COLUMN 8, | LINE 48, | change "cuffing" to --cutting-- |
| CLAIM 9, | COLUMN 8, | LINE 63, | change "cuffing" to --cutting-- |
| CLAIM 10, | COLUMN 9, | LINE 1, | change "cuffing" to --cutting-- |
| CLAIM 12, | COLUMN 9, | LINE 7, | change "cuffing" to --cutting-- |
| CLAIM 13, | COLUMN 9, | LINE 10, | change "cuffing" to --cutting-- |
| CLAIM 14, | COLUMN 9, | LINE 14, | change "cuffing" to --cutting-- |
| CLAIM 16, | COLUMN 9, | LINE 24, | change "cuffing" to --cutting-- |
| CLAIM 16, | COLUMN 9, | LINE 28, | change "cuffing" to --cutting-- |
| CLAIM 18, | COLUMN 9, | LINE 36, | change "cuffing" to --cutting-- |
| CLAIM 19, | COLUMN 10, | LINE 10, | change "discrete one" to --one discrete-- |

Signed and Sealed this
Second Day of July, 2013

Teresa Stanek Rea
*Acting Director of the United States Patent and Trademark Office*